United States Patent [19]

Peltz

[11] 3,933,022

[45] Jan. 20, 1976

[54] METHOD FOR MANUFACTURING BIMETALLIC MEMBERS HAVING SNAP ACTION CHARACTERISTICS

[75] Inventor: John Robert Peltz, Warren, Pa.

[73] Assignee: GTE Sylvania Incorporated, Stamford, Conn.

[22] Filed: Apr. 7, 1975

[21] Appl. No.: 565,753

[52] U.S. Cl. ..... 72/342; 72/364; 113/116 GG

[51] Int. Cl.[2] ..... B21D 53/00

[58] Field of Search ..... 72/342, 364, 379; 29/173, 29/622; 113/116 GG; 267/159

[56] References Cited

UNITED STATES PATENTS 3,683,654 8/1972 Hire ..... 113/116

3,748,888 7/1973 Gerich ..... 267/159

*Primary Examiner*—Lowell A. Larson

*Attorney, Agent, or Firm*—Norman J. O'Malley; Lawrence R. Fraley; Donald R. Castle

[57] ABSTRACT

An improved method is disclosed for controlling the snap-action characteristics of thermally expansive bimetallic members. The improvement comprises heating the bimetallic member during the forming operation which provides the member with said snap-acting characteristics to a temperature substantially greater than the upper temperature limit which defines said characteristics.

7 Claims, 5 Drawing Figures

METHOD FOR MANUFACTURING BIMETALLIC MEMBERS HAVING SNAP ACTION CHARACTERISTICS

BACKGROUND OF THE INVENTION

This invention relates to the manufacture of thermally expansive bimetallic members and more particularly to the manufacture of thermally expansive bimetallic members having snap action capabilities.

Thermally expansive bimetallic members incorporating a snap action response are primarily utilized in switching mechanisms of the thermostatic variety. Perhaps the best known of these devices are thermostatic switches which utilize a bimetallic material having low and high expanding sides joined together along a common interface. Snap action bimetallic switches typically possess two positions of stability with each of these positions responsive to an established temperature. When the temperature of the device is below one (the lower) of these established temperatures, the device is in one of the stable positions. Accordingly, as the ambient temperature about the member is raised to a second (higher) temperature, the thermally responsive member snaps to a second position of stability and remains in this position provided the temperature remains at or above this second level. Should the ambient temperature now be lowered to the first (lower) temperature, resulting in a corresponding lowering of the temperature of the member, the member will snap back to its original position. The difference in temperature between the two described temperatures corresponding to the respective positions of stability is known as the differential temperature.

A known method of manufacturing snap-action switches of the variety described has included a forming operation in which the thermally expansive member is positioned between two opposingly positioned shaping or die members with the members then being actuated to engage the expansive member to provide it with the desired configuration needed to achieve snap action. Such a configuration usually consists of a knee and/or corresponding bowed portion, a dimpled portion or portions, a series of ridges, etc. An example of this type of formation is described in U.S. Pat. No. 3,748,888 wherein a snap action bimetallic disc is provided with a series of scallops which serve as stiffening members. These members in turn are designed to limit the previously described differential temperature range of the bimetallic article.

While the above and similar methods have proven successful in reducing the differential temperature, none to date have been capable of varying the differential range of the articles during their manufacture without requiring rather extensive modifications to the equipment making the member or to the member itself. That is, there has never been developed a method capable of changing the snap action characteristics of consecutively produced thermally expansive members without requiring either a complete change in the defining die members or substantial modification thereto. Such alterations to the snap action characteristics are often necessitated as a result of varying operational requirements. For example, it may be desirous to produce a bimetallic snap action member having a differential temperature range of about 40°F with an upper limit or "ON" temperature (2nd stable position) of 100°F and a corresponding lower limit or "OFF" temperature (1st stable position) of 60°F. To now provide a similar bimetallic member with an "ON" of 105°F and an "OFF" of 65°F has previously required a complete change in the defining die bodies or the thicknesses of the expansive members being formed. In effect, what is now produced is an entirely different bimetallic member. Further, to provide a second bimetallic member having similar thickness dimensions with a broader or more narrow differential range has necessitated the previously described modifications to the dies to provide deeper (or more narrow) dimples, scallops, etc. As can be appreciated, the above described changes have resulted in both added costs and time required to produce said articles.

It is believed therefore that an improved method for controlling the snap action characteristics of thermally expansive bimetallic members during their manufacture without requiring extensive modifications or changes in the equipment which provides these characteristics or in the configuration of the members themselves would constitute an advancement in the art.

OBJECTS AND SUMMARY OF THE INVENTION

It is therefore a primary objective of the present invention to provide an improved method for controlling the snap action characteristics of thermally expansive bimetallic members during the manufacture of these members.

It is an even further object of the invention to provide a method as described which will eliminate the necessity for extensive modifications to the forming equipment which defines said members or to the configurations of the members themselves.

In accordance with one aspect of the invention, there is provided an improved method for manufacturing a thermally expansive bimetallic member having snap action characteristics. The improvement comprises heating the bimetallic member during the formation operation which provides the member with the described snap action characteristics. As described, the member is heated to an established temperature substantially above the upper limit of the predetermined temperature range corresponding to the mentioned snap action characteristics.

DETAILED DESCRIPTION OF THE PREFERRED EMBODIMENTS

For a better understanding of the present invention, together with other and further objects, advantages and capabilities thereof, reference is made to the following disclosure and appended claims in connection with the above-described drawings.

Figure 1:
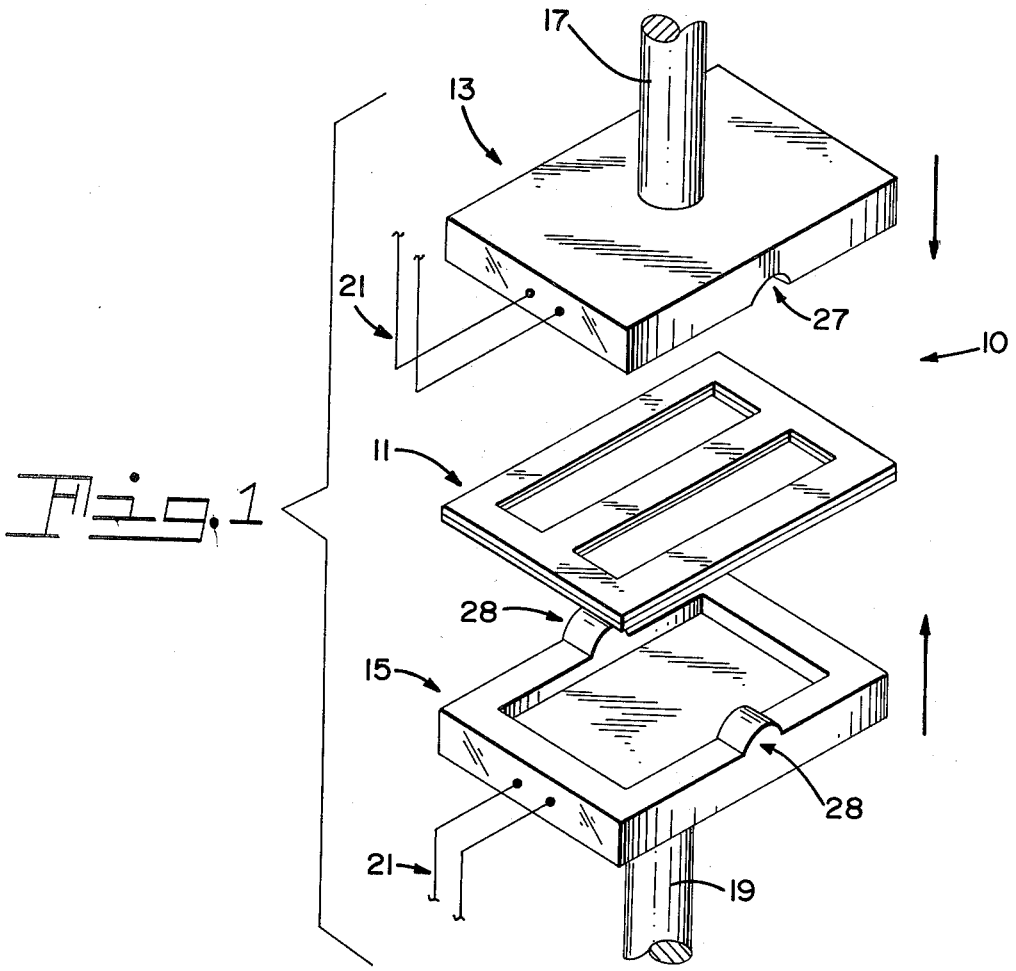
FIG. 1 is an isometric view of a forming apparatus for use in the method of the present invention.

With particular reference to FIG. 1, there is illustrated a forming apparatus 10 for forming a thermally expansive bimetallic member having snap action characteristics. More specifically, forming apparatus 10 is particularly adapted for providing a thermally expansive bimetallic member 11 with said characteristics when member 11 is positioned therein.

Apparatus 10 is shown to comprise a pair of opposing shaping or die members 13 and 15 which are adapted for providing member 11 with a desired number of indentations which, when provided, assure snap action. Thermally expansive member 11 is substantially flat in form and therefore only possesses normal thermal expansive properties. That is, bimetal 11 will deflect in a non-snap action type movement when the member is subjected to either a heated or cooled ambient environment.

The first step in providing member 11 with the desired snap action characteristics is to position the member between shaping members 13 and 15. Thereafter, each member is actuated in the direction indicated to engage member 11 and impart the required indentations. Shaping members 13 and 15 are shown as being joined to a pair of corresponding shaft members (17 and 19, respectively) which in turn are operatively joined to a drive means (not shown). Such a drive means can be powered hydraulically, electrically, etc. Because several of the mentioned types of drive means are well known in the art, further description is not believed necessary.

It has been established practice in the formation of many snap action type thermally expansive members to provide such members with the required operating characteristics in a forming apparatus such as described. However, the apparatus as described were somewhat limitive in nature in that there has never been known a means whereby the operating capabilities of the expansive member could be varied or controlled while in the apparatus. For example, if it were desired to change the ON-OFF temperature parameters, it was necessary to perform modifications to the shaping members, the thicknesses of the materials used, or the materials themselves. More often than not, this resulted in an extensive alteration to the configuration of the bimetal as ultimately produced.

As can be appreciated, modifications of the variety described have been both time consuming and costly in terms of manufacturing dollars. Die changes required a complete shut down of machinery, readjustments, and subsequently, a complete retesting program. Furthermore, modifications of design require alterations to the corresponding housing or assembly in which the manufactured bimetal is to be positioned. The method of the present invention eliminates the necessity for the above-described alterations to equipment, bimetal, etc. The snap acting thermally expansive member produced in accordance with the preferred method to be described can be provided with any of several different temperature differentials and/or ON-OFF temperature parameters without the unnecessary modifications as described. The unique features as mentioned are provided by an improved forming method incorporating a pair of heated shaping members which serve to heat the bimetal during the forming operation. That is, shaping members 13 and 15 are each provided with heating means 21 and 21' in order that they may be heated to an established temperature when they engage member 11 to provide the required snap action characteristics. Means 21 and 21' are each shown as being electrically connected to the shaping members and comprise a series of imbedded resistive heaters strategically positioned within members 13 and 15. Accordingly, heating means 21 and 21' are each electrically joined to a power source (not shown) which provides the desired source of electrical power. It is to be understood that the illustrated electrical heating means represent but one of several methods capable of heating members 13 and 15. For example, a series of externally positioned electrically powered hot air guns or fuel-powered burner assemblies could provide the required heating. Additionally, heating can be provided by circulation of a hot fluid media through each of the shaping members.

It is to be understood that the preferred method of the present invention can successfully form practically any bimetallic article having two layers and capable of thermal expansion. A preferred bimetal successfully used in the present invention is well known in the art as Chace 2400 bimetal, manufactured by the W. M. Chace Company of Detroit, Mich. Chace 2400 has a high expanding side consisting essentially of about 22 percent by weight nickel, 3 percent by weight chromium, and the remainder iron. Additionally, Chace 2400 has a low expanding side consisting essentially of about 36 to 42 percent by weight nickel with the remainder iron. Further characteristics of this bimetal include a strip deflection constant of about $76 \times 10^{-7}$ for temperature ranges of 0° F to 300°F and a modulus of elasticity of about $25 \times 10^6$ lbs./in$^2$. The bimetal also has a useful deflection temperature range of about −100°F to about 700°F.

Figure 2:
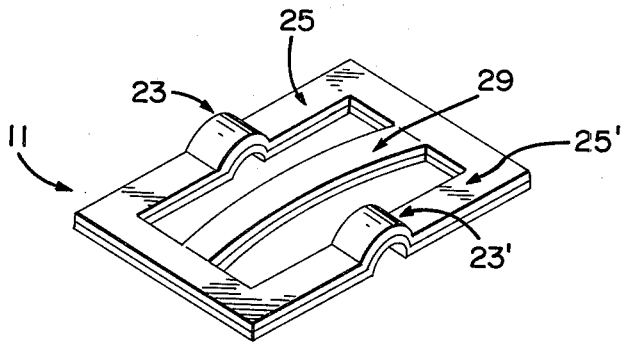
FIG. 2 is an isometric view of a thermally expansive bimetallic member having snap action capabilities as provided by the apparatus of FIG. 1.

In FIG. 2, expansive member 11 is shown to now include the desired snap action characteristics as provided by appartus 10. Member 11 has been provided with at least two upstanding knee (or dimple) portions 23 and 23'. Knee portions 23 and 23' are each located within an outside leg portion (25 and 25' respectively) of member 11 and are formed as a result of each leg having been engaged by shaping members 13 and 15 in the manner indicated. More particularly, member 13 is provided with a pair of recessed portions 27 and member 15 is provided with a corresponding pair of upstanding portions 28 which mate with legs 25 and 25' respectively when member 11 is positioned therebetween.

As can be understood, when member 11 is provided with the illustrated knee portions 23 and 23', there is created a stress within the member's center leg portion 29. This stress in turn results in leg 29 being bowed upward in the manner illustrated. Accordingly, when member 11 is positioned within a heated environment and leg 29 is thermally deflected in an opposing manner to that illustrated, snap action is provided as a result of outer legs 25 and 25' maintaining their substantially shorter lengths.

As has been described, snap action bimetallic members provide several useful purposes, some major ones being utilization in thermostatic switching devices for electric appliances, home heating, electric blankets, heating pads and automotive electric choke assemblies for automobiles. Assemblies of the latter type are commonly associated with many carburetion systems in today's internal combustion engines. As is known, such a switching member is designed to trigger an electrical circuit at a relatively low temperature range to assure that electrical current is provided the choke assembly to in turn cause a relatively rapid opening of the carburetor's throat valve during engine warmup. This action assures a better air-fuel ratio, resulting in less waste of hydrocarbons and other toxic or poisonous byproducts of internal combustion. The switching member is further designed for returning to its normally closed (or OFF) position once the established lower temperature is again reached. This normally occurs after the engine has been turned off for a period of time.

Figure 3:
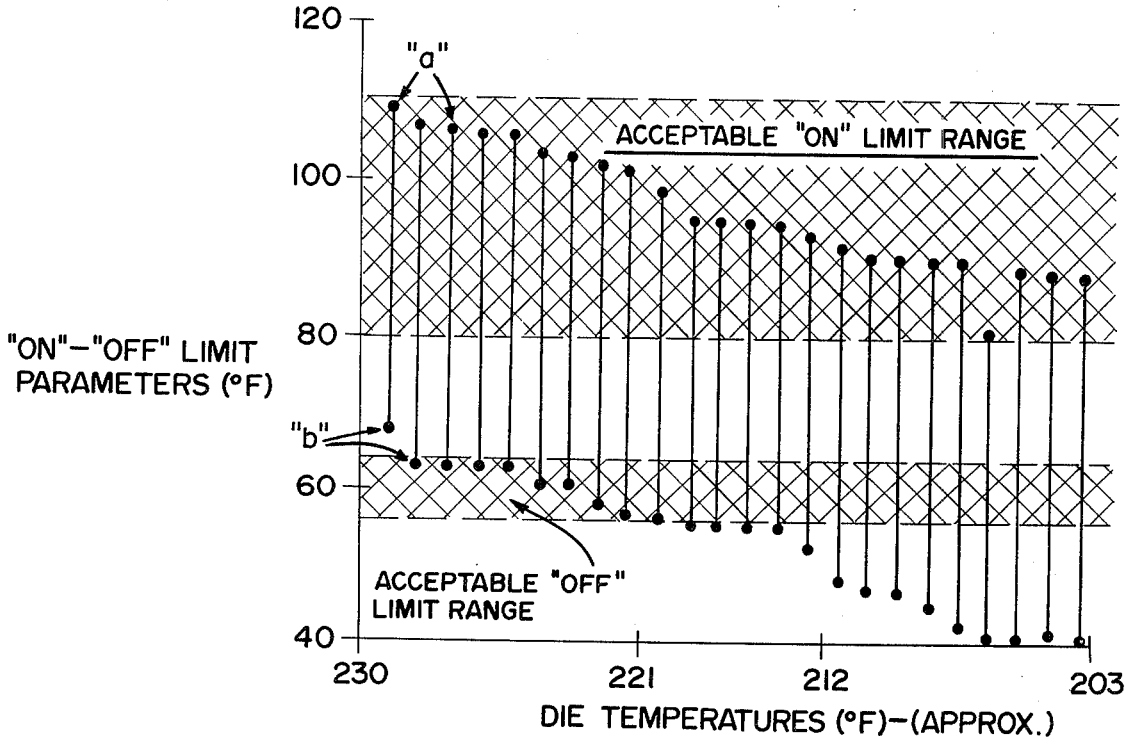
FIGS. 3–5 are graphical illustrations of test results relating to snap action characteristics for thermally expansive members as manufactured in accordance with the method of the present invention.
Figure 4:
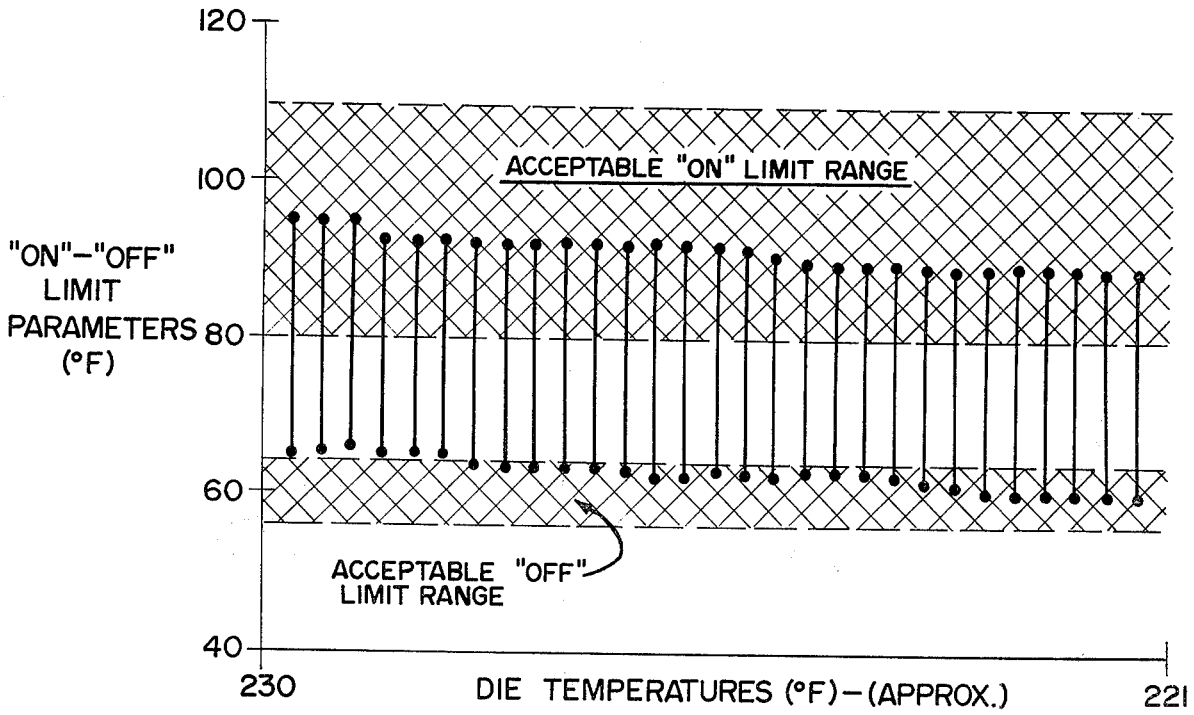
Figure 5:
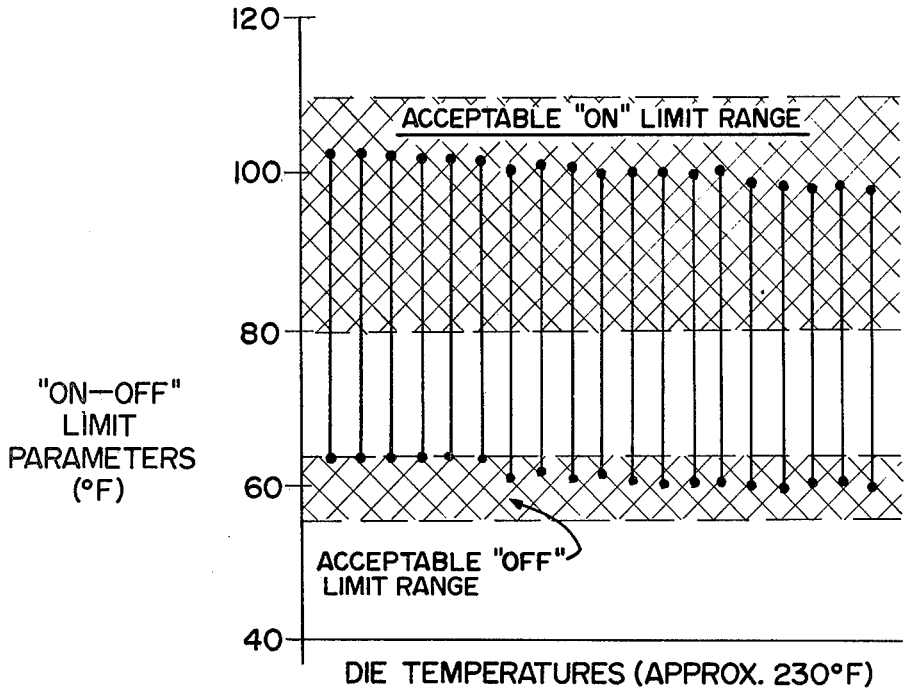

FIGS. 3–5 represent a series of test results obtained when subjecting several Chace 2400 bimetallic members each similar in configuration to bimetal 11 in FIG. 1 to the preferred forming operation of the present invention. The thicknesses for these members were all within the range of 0.006 to about 0.010 inches. As illustrated, each of the respective graphs for FIGS. 3–5 have as an ordinate the preferred (or acceptable) "ON" and "OFF" limit parameters for the articles being formed. As previously described, the "ON" range represents the second (or upper) stable position for the bimetal while the "OFF" range designates the first (or lower) stable position. For the particular example to be described, an acceptable upper limit ("ON") range is from about 80°F to about 110°F while an acceptable lower limit ("OFF") range is from about 56°F to about 64°F. These ranges are of course established by the maanufacturer who eventually will utilize the formed bimetals. In the examples represented in FIGS. 3–5, this utilization is for the previously described automatic choke assemblies for internal combustion engine carburetion systems. Accordingly, it has been determined that successful operation of the automatic choking mechanism can be achieved when using the illustrated "ON" — "OFF" range parameters.

The abscissa of each of the graphs of FIGS. 3–5 represents the temperature ranges (°F) to which the forementioned die or shaping members are heated. As stated, this also substantially represents the temperature to which each of the bimetals will be heated. During the forming operation, each of the bimetals was positioned within apparatus 10 and provided with the described snap action characteristics in the manner shown in FIG. 1. The graphs of FIGS. 3–5 illustrate the results of utilizing various temperatures for shaping members 13 and 15 during this operation.

During the testing represented in FIG. 3, shaping members 13 and 15 were varied from a high temperature of about 230° F to a low of about 200° F. Actually, this was accomplished by first heating the members to the higher temperature and permitting them to subsequently cool at their own rate. During this "cooling" period, several forming operations on a corresponding number of substantially identical Chace 2400 bimetals were performed. In FIG. 3, each of the vertical designates having an upper and lower defining point (*a* and *b*, respectively) represents the triggering temperatures for each of the bimetallic members formed. Accordingly, the difference between these points represents the resulting temperature differentials. As stated, the thicknesses for each of these bimetals were approximately 0.006 – 0.010 inches. The forementioned triggering temperatures were determined from a series of subsequent tests performed on the formed articles after each had cooled for an established period at normal ambient temperatures, i.e., room temperature (70° F).

As clearly illustrated, varying the temperatures of the shaping members during the forming process resulted in corresponding variations of the ∓ON-OFF" limit parameters as well as variations in the temperature differentials for each bimetal. This first series of tests clearly indicate that the snap-action characteristics for similar bimetals can be modified substantially by altering the temperatures of shaping members 13 and 15.

As further evidenced in FIG. 3, once these temperatures exceeded an established point, the corresponding acceptable ranges were also exceeded, particularly those in the lower or "OFF" limit range. Because these ranges are considered critical for the particular application, it has therefore been determined which die temperatures are acceptable for utilization in the forming process when using the described bimetal. It can also be seen in FIG. 3, that as the die temperatures approached approximately 230° F, the lower or "OFF" limit range was again exceeded. Accordingly, it has been readily determined which die temperatures resulted in acceptable results for this particular application.

It can be understood from the results obtained in FIG. 3 that the parameters which define the snap-action characteristics of the bimetal formed and the respective temperature differential can be modified during the described forming operation without requiring extensive modification to the shaping members 13 and 15. Further, FIG. 3 illustrates that if the defining criteria for these snap-action characteristics is changed by the manufacturer, it is now only necessary to alter the temperatures of the shaping members during the forming process to achieve these new ranges. The above remains true for practically any bimetallic member formed within apparatus 10. That is, once the described configuration and thickness is established, modification to the snap-action defining parameters can be achieved by a corresponding altering of the die temperatures utilized.

Similar to FIG. 3, FIGS. 4 and 5 illustrate the results of several tests performed on snap-action bimetallic members formed at established die temperatures. In FIG. 4, the die temperatures were controlled within a temperature range of approximately 220° F to about 230° F. As in FIG. 3, the dies were heated to approximately 230° F and thereafter permitted to lower in temperature. However, the rate of this lowering was reduced substantially in comparison to the rate of FIG. 3. The subsequent test results indicate a relatively stable range for "ON" and "OFF" parameters and corresponding temperature differentials. Again it is evident that as the die temperature lowered only a few degrees, the above parameters were also modified slightly. It is submitted that the results obtained in FIG. 4 are clearly indicative that a precisioned forming operation has been provided by the present invention. Upper and lower parameters and temperature differentials may be varied by only a few degrees (F) as a result of corresponding changes in the temperature of the shaping members. It has also been shown that these temperatures may be maintained within such minimal limitations by a corresponding maintaining of the described die temperatures.

The testing data illustrated in FIG. 5 was achieved as a result of maintaining the shaping member temperatures at an established temperature, that being approximately 230° F. In this series of tests, the upper and lower parameters were maintained within the acceptable ranges as defined by the manufacturer.

In summary, the above provided test data clearly indicates that acceptable "ON" and "OFF" parameters and corresponding temperature differentials may be achieved during a forming operation providing snap action characteristics as a result of a corresponding maintainence of the temperatures for the shaping members used. For Chace 2400 bimetals having a thickness within a range of about 0.006 to about 0.010 inches, an acceptable upper range of about 80° F to about 110° F and an acceptable lower range of about 56° F to about 64° F can be achieved by maintaining the shaping member temperatures within the range of about 220° F to about 230° F. It is also understood from the above results that the defining parameters of other bimetals of different compositions and/or thicknesses can also be controlled using the method of the present invention. However, it would probably be necessary to utilize different die temperatures depending on the components used. It can also be summarized from the above tests that the preferred temperatures for the die members substantially exceeded the "ON" or upper limit parameters which define the snap action characteristics for the bimetal. In the particular tests represented, the die temperature and therefore the temperature of the bimetal during the forming operation was preferably established at a ratio to the upper limit parameter of at least 2:1. This is not meant however to be limitive to the broad concept of the present invention as it is easily understood that different bimetals having correspondingly different characteristics may in turn require substantially different die temperatures.

In all of the tests performed above, the bimetallic members formed were positioned within apparatus 10 for only a relatively brief period. This brief period, which ranged from about 1 second to about 3 seconds, is further indicative of the described method being readily adaptive to mass production.

It is also preferred to provide a subsequent step in the forming process described although this is not considered essential and therefore not within the broad concepts of the present invention. This step involves heating each of the formed members to a temperature within the range of about 390° F to about 450° F for a period of approximately one hour. This heating step is primarily desired as a "stabilization" function and is accomplished after the formed articles have cooled for an established period at normal ambient temperatures, such as room temperature of approximately 79° F.

It has been determined that such a step results in improved stability of the operating characteristics of the formed articles with little tendency for these characteristics to vary during subsequent operation. As stated, the above step is preferred only as an added function and therefore does not constitute what is considered the broad aspects of the invention. That is, bimetals formed without the inclusion of this subsequent heating process have fully met the operating requirements established.

Thus there has been shown and described an improved method for forming a thermally expansive member having snap-action characteristics. The improvement comprises heating bimetal as a result of a corresponding heating of the shaping members which form the bimetal to an established temperature above the upper limit operating range of these characteristics.

While there has been shown and described what are at present considered the preferred embodiments of the invention, it will be obvious to those skilled in the art various changes and modifications may be made therein without departing from the scope of the invention as defined by the appended claims.

What is claimed is:

1. An improved method for controlling the snap action characteristics of a thermally expansive bimetallic member during the manufacture of said bimetallic member wherein said snap action characteristics are defined by a predetermined temperature range having upper and lower limits, said bimetallic member being provided said characteristics during a forming operation utilizing at least two opposing shaping members for engaging said bimetallic member for an established time period when said bimetallic member is positioned therebetween and imparting a predetermined shape thereto, said improvement comprising: heating said bimetallic member to an established temperature substantially above said upper limit of said predetermined temperature range for said snap action characteristics during said period of engagement by said opposing shaping members.

2. The improvement according to claim 1 wherein said established temperature for heating said bimetallic member is at least twice said upper limit of said predetermined temperature range for said snap action characteristics.

3. The improvement according to claim 1 wherein said established temperature for heating said bimetallic member is within the range of from about 220°F to about 230°F.

4. The improvement according to claim 1 wherein said established time period for engagement of said bimetallic member by said shaping members is from about 1 second to about 3 seconds.

5. Improvement according to claim 1 further including heating said expansive member to a predetermined temperature after said expansive member has been permitted to cool to normal ambient temperature.

6. The improvement according to claim 5 wherein said predetermined temperature to which said expansive member is heated after said cooling is within the range of about 390°F to about 450°F.

7. The improvement according to claim 6 wherein said predetermined temperature is maintained for approximately one hour.

* * * * *

UNITED STATES PATENT OFFICE

CERTIFICATE OF CORRECTION

PATENT NO. : 3,933,022

DATED : January 20, 1976

INVENTOR(S) : John Robert Peltz

It is certified that error appears in the above-identified patent and that said Letters Patent are hereby corrected as shown below:

Col. 5, line 21 - Delete "maanufacturer" and insert -- manufacturer --.

Col. 5, line 63 - Delete "+-ON-OFF" and insert -- "ON-OFF" --

Col. 7, line 41 - Delete "79 $^{o}$F" and insert -- 70 $^{o}$F --.

Signed and Sealed this

*thirteenth* Day of *April 1976*

[SEAL]

*Attest:*

RUTH C. MASON
*Attesting Officer*

C. MARSHALL DANN
*Commissioner of Patents and Trademarks*